United States Patent [19]

Foley

[11] Patent Number: 4,989,670

[45] Date of Patent: Feb. 5, 1991

[54] HEAT EXCHANGER

[75] Inventor: Peter N. Foley, Shoeburyness, England

[73] Assignee: York International Corp., Basildon, England

[21] Appl. No.: 352,810

[22] Filed: May 17, 1989

[30] Foreign Application Priority Data

May 19, 1988 [GB] United Kingdom ..... 8811813.8

[51] Int. Cl.[5] ..... F28F 9/24; F28F 9/26

[52] U.S. Cl. ..... 165/143; 165/163

[58] Field of Search ..... 165/143, 163, 144

[56] References Cited

U.S. PATENT DOCUMENTS

| | | | |
|---|---|---|---|
| 937,344 | 10/1909 | Walter | 165/143 |
| 1,655,086 | 1/1928 | Blanding | 165/163 |
| 3,048,372 | 8/1962 | Newton, Jr. | 165/143 X |
| 3,171,478 | 3/1965 | Weiks | 165/143 |
| 4,323,114 | 4/1982 | Corey | 165/78 |
| 4,852,644 | 8/1989 | Schlemenat et al. | 165/158 |

FOREIGN PATENT DOCUMENTS

| | | | |
|---|---|---|---|
| 1929695 | 1/1970 | Fed. Rep. of Germany | 165/143 |
| WO81/00297 | 2/1981 | PCT Int'l Appl. . | |

*Primary Examiner*—Martin P. Schwadron
*Assistant Examiner*—Allen J. Flanigan
*Attorney, Agent, or Firm*—Finnegan, Henderson, Farabow, Garrett & Dunner

[57] ABSTRACT

A heat exchanger unit comprises a plurality of heat exchangers of a construction in which a number of tubes are mounted on mounting plates, which additionally serve as manifolds, in a manner such that the tubes maintained in spaced relation while being twisted such that their axes conform to parts of helices.

12 Claims, 2 Drawing Sheets

HEAT EXCHANGER

The present invention relates to a heat exchanger.

So called "shell and tube" and "tube-in-tube" heat exchangers are both well known for use, for example, in heat pumps used for heating and/or cooling purposes, to carry out heat exchange between the refrigerant of the heat pump and a working medium such as water.

Shell and tube heat exchangers have the disadvantage that they require different materials in their construction (such as copper and steel) which require welding, thus increasing the cost of manufacture and in many cases necessitating pressure vessel authority code approval (TUV, ANCC, Service Des Mines).

Tube-in-tube heat exchangers on the other hand can be fabricated entirely in copper, which means that simple brazing, rather than welding, can be used. Conventionally, the outer tube is wound in the form of a helix and the inner tubes extend parallel to the helical axis of the outer tube. This helical construction ensures that the fluid flows are not laminar, thereby improving heat exchange, and reduces the space requirement of the heat exchanger. A problem with a conventional tube-in-tube helical heat exchanger, which would typically have a heat exchange capacity of the order of seven tons (refrigeration duty), is that if it is desired to cascade such heat exchangers to provide a multiple of that capacity, connecting them in series leads to unacceptable fluid pressure drops, while connecting them in parallel results in a construction occupying a great deal of space, because of the dead space inherent in the helical design.

The present invention is intended to provide a modular heat exchanger which is simpler and cheaper to construct than conventional helical tube-in-tube heat exchangers while avoiding a configuration of the inner tubes which would promote laminar flow of the working medium through them.

According to a first aspect of the present invention there is provided a heat exchanger for exchanging heat between first and second working media comprising an elongate chamber having a plurality of tubes extending through it to provide a flow path for the first working medium, the interiors of the tubes being isolated from the space within the chamber surrounding the tubes which provides a flow path for the second working medium, the ends of the tubes at opposite ends of the chamber being twisted relative to one another so that their axes conform to parts of helices extending along the chamber.

The chamber can be of any desired configuration but is preferably a simple straight tube having an internal diameter sufficient to accommodate the inner tubes and the desired flow capacity of the second working medium. Thus the pipework of the heat exchanger can be constructed entirely of copper.

In heat pump applications, the working medium passed through the first path will be refrigerant while that passed through the second path can be water.

The required twisted configuration of the inner tubes can be achieved very simply. First a pair of end plates can be provided with respective holes into which the inner tubes are fitted at this stage the tubes are straight and parallel to one another. Then, in the course of fitting this sub-assembly into the chamber, one end plate is twisted relative to the other through a suitable angular distance around the axis of the sub-assembly and the sub-assembly (eg, 90° or 180° ) is thereafter secured in position in the chamber in this twisted configuration.

A second aspect of the present invention comprises a heat exchanger unit comprising a plurality of heat exchangers according to the first aspect of the present invention and respective manifolds for admitting the first and second working media to and removing them from the first and second flow paths. The heat exchangers, and preferably also the manifolds, can be encased in a block of heat insulating materials such as foamed plastics moulded around them.

The invention will be further described by way of non-limitative example with reference to the accompanying drawings in which.

The drawings show a heat exchange unit 1 according to the present invention for use in refrigerant to water heat exchange which provides two independent refrigerant flow paths and a common water flow path.

In the example, the heat exchange unit comprises four heat exchangers 3*a*–3*d* according to the present invention, the heat exchangers 3*a* and 3*b* providing one refrigerant flow path and heat exchangers 3*c* and 3*d* constituting the other. The common water flow path is via inlet Tee 5 and outlet Tee 7. It will be seen from FIG. 2 that the heat exchangers 3 and the water inlet and outlet Tees 5 and 7 are arranged in a generally rectangular configuration.

Figure 3:
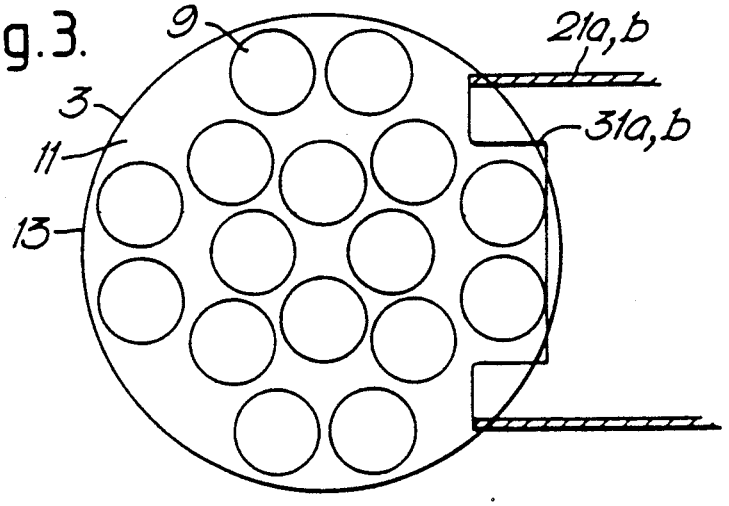
FIG. 3 shows the configuration of the inner tubes at one end of one of the heat exchangers relative to one of the manifolds.

As shown in FIG. 3, each of the heat exchangers 3 incorporates a plurality, in this case, 16, tubes 9 through which the refrigerant flows. A flow path for the water is provided by the space 11 between the inner surface of the outer tube 13 of each heat exchanger 3 and the outer surface of the tubes 9.

Figure 1:
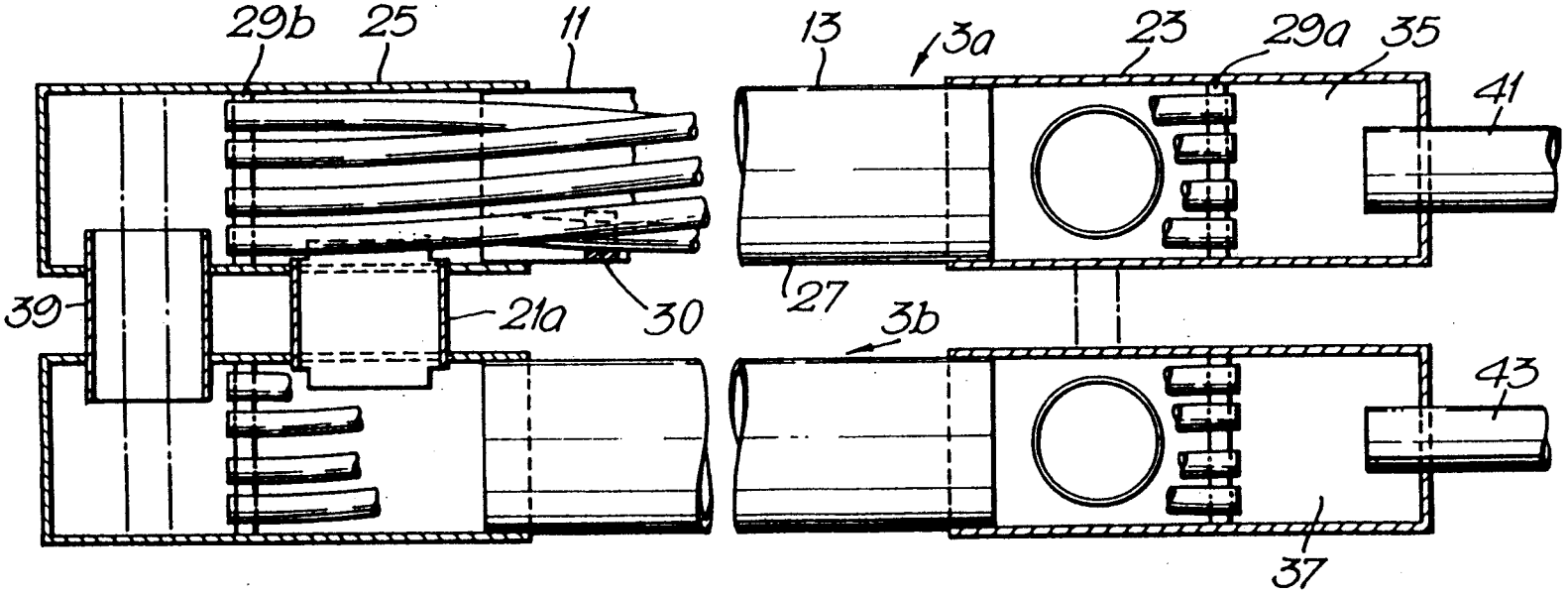
FIG. 1 is a longitudinal sectional view through one half of a heat exchange unit according to the present invention.

At the right hand end in FIG. 1 of the heat exchange unit, the spaces 11*a* and 11*c* are connected to one another and to the water inlet via the Tee 5 while the spaces 11*b* and 11*d* are connected to one another and to the water outlet via the Tee 7.

At the left hand end in FIG. 1, the spaces 11*a* and 11*b* on the one hand and 11*c* and 11*d* on the other are connected together via respective vertical tubes 21*a* and 21*b*.

As shown in FIG. 1, each of the heat exchangers 3 comprises two end tubes 23 and 25 interconnected via a central tube 27 to which they are brazed. The tubes 9 are mounted on two end plates 29*a* and 29*b*. The end plates 29*a* and 29*b* have a number of holes for the tubes 9 in the layout shown in FIG. 3. In the course of assembly, the tubes 9, in a parallel condition are fitted into these holes and then the tubes are brazed to the end plates to provide a seal. In the course of installing this assembly, the end plate 29*b* is brazed to the end tube 23 in a condition such that two of the pipes 9 are accommodated in the cut-outs 31*a*, 31*b* in the Tee 21*a* or 21*b*. Prior to brazing the other end plate 29*a* to the tube 23, the end plate 29*a* is twisted through a suitable angle, eg, 90° or 180° , relative to end plate 29*b* so that the tubes 9 assumes a helical configuration and so that another pair of tubes 9 are accommodated in a cut-out 33 provided in the relevant one of the Tees 5 and 7. These cut-outs 31 and 33 provide a convenient reference in the course of assembly.

It should be noted that in larger diameter constructions the tubes 13, 23 and 25 can be in one piece; in those circumstances the left hand end of each tube 25 can simply be plugged.

Spacers 30 can be placed between the tubes 9 at intervals along their lengths. These spaces can serve the dual functions of maintaining a desired spacing between the tubes and disrupting the laminar flow of medium over the surface of the associated tube. The spacers can either be staggered at intervals along the tubes (ie, so that spacers of different tubes are at different longitudinal positions) or, if it is desired limit the peripheral bypass of medium around the outer ring of inner tubes, longitudinally aligned spacers may be provided at intervals on the tubes of that ring. In either case the spacers could be short annular sleeves fitted on individual tubes; these do not require to be secured in place because they will be held in situ by the realignment of the axes of the tubes 9 when they are twisted.

Refrigerant inlet and outlet manifolds 35 and 37 are provided by the space between the end plates 29*a* and the inner surface of the tubes 23. A refrigerant transfer manifold is provided by the spaces between the interiors of the tubes 25 and the end plates 29*b* and a vertical tube 39.

Figure 2:
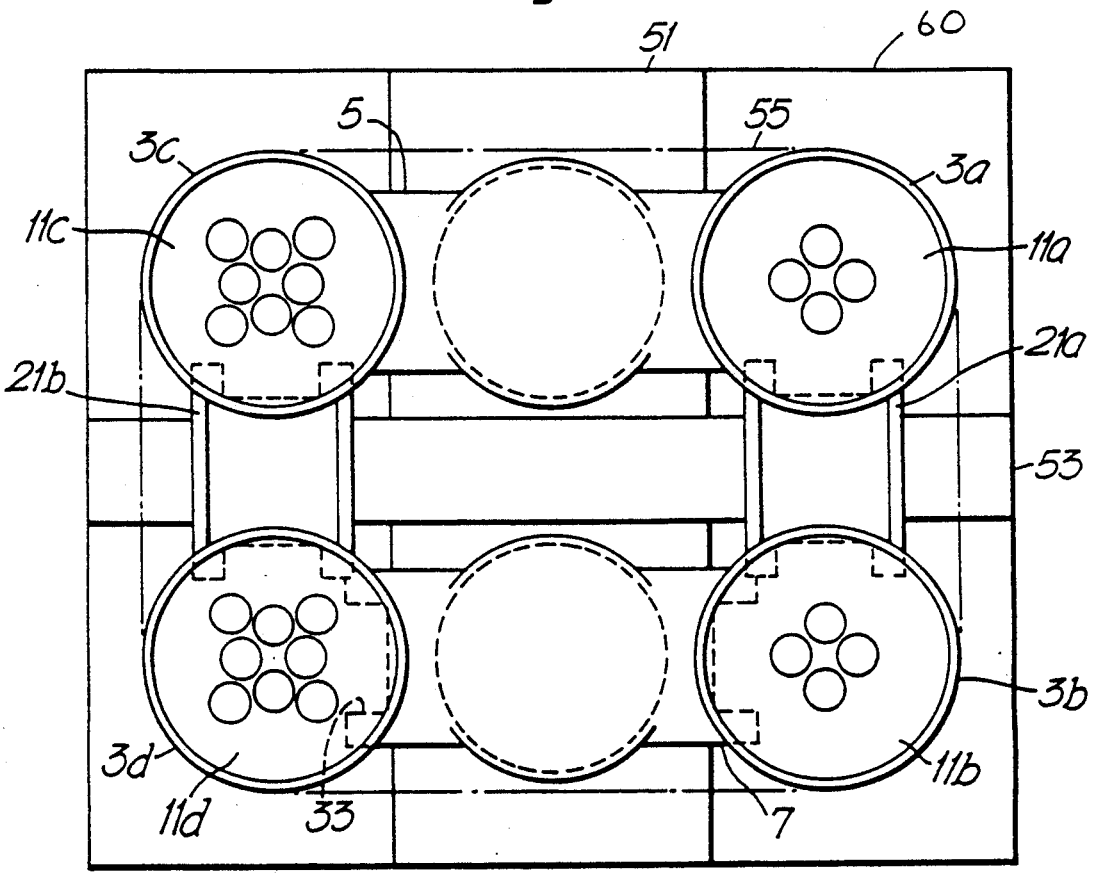
FIG. 2 is a somewhat diagrammatic end elevation heat exchange unit of FIG. 1.

Thus considering the right hand pair of heat exchanges 3 in FIG. 2, refrigerant enters via an inlet pipe 43 into the inlet manifold 37, passes in flow parallel through the tubes 9 of the heat exchanger 3*b* and is then transferred to the heat exchanger 3*a* via the refrigerant transfer manifold 39 and exits the unit via the outlet manifold 35 and outlet pipe 41. Equally, the water entering through the inlet Tee 5 flows in parallel into the spaces 11*a* and 11*c* in the heat exchangers 3*a* and 3*c*, passes along the lengths of these heat exchangers and is then returned to the outlet Tee 7 via the water transfer manifolds 12*a* and 21*b*, the spaces 11*b* and 11*d* lengths to the outlet Tee 7.

mounting plates 51 and 53 are fitted to the heat exchange assemblies at each end to maintain the correct horizontal and vertical spacing of the individual heat exchangers 3. Straps 55 are applied to rigidify the assembly. The unit may, if desired, be encased in heat insulating material such as expanded polyurethane foam moulded around it and the resulting assembly may then be adapted to environmental conditions for example by having an anti-vermin foil wrapped around it.

The above described heat exchangers may be used as either the evaporator or condenser heat exchanger of a heat pump, as well as for other heat exchange applications. When used as a condenser the inner end of the liquid refrigerant outlet tube 43 may be turned down to face the lower wall of the tube 23 to assist in collecting the condensed refrigerant or the outlet may be taken from the underside of the lower tube 23.

The heat exchange unit as shown is particularly well suited for use in the type of air/refrigerant refrigerant-/water types of heat pump in which two air to refrigerant heat exchangers are arranged in a "V" configuration on a bed; the heat exchange unit of the invention can readily be installed on the bed under the space between either limb of the "V" and the bed.

The above described construction has been used to construct a 20 ton capacity heat exchange unit with significant savings in cost compared with a conventional tube-in-tube heat exchanger.

The capacity can be adjusted by varying the number circuiting prevents total by-pass of some unchilled water with the resultant deterioration of thermal performance. This option is not possible when using conventional shell and tube coolers in parallel with no means to cross-circuit the water flow within the exchanger.

The above concepts are also applicable to exchanger units having different numbers of shells and different numbers of tubes per shell for performance optimization purposes.

The inlets and outlets for both media may be at the same end of the unit or opposite ends depending on the number of passes through the unit.

I claim:

1. A refrigerant evaporator liquid-to-refrigerant tube-in-tube heat exchanger for use in a tube defining an elongated chamber having a longitudinal axis and two ends; a plurality of inner tubes extending through the elongated chamber to provide a flow path for the refrigerant, the tubes being disposed side by side to one another to form a bundle and each having two ends, an inlet and an outlet at opposite ones of said ends, a longitudinal axis and an interior connecting the inlet and outlet, the interiors of the tubes being isolated from the space within the chamber surrounding the tubes, which space provides a flow path for the liquid, the bundle of tubes being provided with a pair of end mountings adjacent the respective ends of the tubes thereof, the end mountings being angularly offset relative to one another about the axis of the outer tube whereby the bundle of tubes is twisted to a helical configuration with each tube of the bundle having the same amount of angular twist; and a keying formation fixed relative tot he outer tube and in keyed engagement with the periphery of the tube bundle at one end thereof and keying the angular orientation of that end of the bundle relative to the longitudinal axis of the outer tube.

2. A heat exchanger according to claim 1 and further comprising a distribution manifold at one of said ends of the chamber and having an inlet for the first working medium and a plurality of outlets respectively communicating with the inlets of the plurality of tubes.

3. A heat exchanger according to claim 2 further inlets communicating respectively with the plurality of tubes and a common outlet.

4. A heat exchanger according to claim 1 further comprising a pair of plates with which the plurality of tubes form a sub-assembly, the tubes having outer walls, the plates having means defining respective arrays of apertures through which the ends of the tubes extend, the plates being sealed to the outer walls of the tubes, the arrays of aperture defined in the two plates being angularly offset around the longitudinal axis of the chamber relative to one another such as to cause the part-helical configuration of the tubes.

5. A heat exchanger according to claim 4 wherein the chamber is tubular and the plates are disks sealed against the chamber defining means.

6. A heat exchanger according to claim 1 further comprising spacers fitted to the external walls of the tubes at intervals along the length of the chamber.

7. A refrigerant evaporator refrigerant to liquid heat exchanger comprising:

a plurality of heat exchangers, each heat exchanger comprising: an outer tube defining an elongated chamber having a longitudinal axis and two ends;

a plurality of inner tubes extending through the elongated chamber to provide a flow path for the refrigerant, the tubes being disposed side by said to one another to form a bundle and each having two ends, an inlet and an outlet at opposite ones of said ends;

a longitudinal axis and an interior connecting the inlet and outlet, the interiors of the tubes being isolated frmo the space within the chamber surrounding the tubes, which space provides a flow path for the liquid, the bundle of tubes being provided with a pair of end mountings adjacent the respective ends of the tubes thereof, the ends mountings being angularly offset relative to one another about the axis of the outer tube whereby the bundle of tubes is twisted to a helical configuration with each tube of the bundle having the same amount of angular twist; and a keying formation fixed relative to the outer tube and in keyed engagement with the periphery of the tube bundle at one end thereof and keying the angular orientation of that end of the bundle relative tot he longitudinal axis of the outer tube;

the inner tubes of the heat exchangers and said spaces providing, respectively, a first flow path for the refrigerant and a second flow path for the liquid; and respective manifolds for admitting the refrigerant to and removing it from the first flow path.

8. A unit according to claim 7 wherein there is a group of the heat exchangers disposed in side by side relation, further comprising a distribution manifold arranged to deliver the second working medium in flow parallel to the respective second flow paths of the heat exchangers of the group.

9. A unit according to claim 7 and having two ends, wherein a group of the heat exchangers is disposed in side by side relation extending between the ends of the unit, the unit further comprising a transfer manifold at the other one of the ends of the unit connecting the first flow paths of these two heat exchanges in flow-series manner and a collection manifold at the first one of the ends of the unit for receiving the first working medium from the first flow path of the downstream one of these two heat exchangers.

10. A unit according to claim 8 wherein a further group of the heat exchangers is disposed in side by side relation extending between the ends of the unit, the unit further comprising a transfer manifold at the other one of the ends of the unit connecting the first flow paths of these two heat exchangers in flow-series manner and a collection manifold at the first one of the ends of the unit for receiving the first working medium from the first flow path of the downstream one of these two heat exchangers; and wherein the first-mentioned and further groups of heat exchangers are disposed in side by side overlying relation with the second flow paths of the two groups in flow-series relation and further comprising transfer conduits provided at the other end of the unit for delivery of the second working medium from the second flow paths of the heat exchangers of the first-mentioned group to the second flow paths of the heat exchangers of the second mentioned group.

11. A unit according to claim 7 wherein the heat exchangers are strapped together.

12. A unit according to claim 7 further comprising a block of heat-insulating material in which the heat exchangers are embedded.

* * * * *

UNITED STATES PATENT AND TRADEMARK OFFICE

CERTIFICATE OF CORRECTION

PATENT NO. : 4,989,670

DATED : February 5, 1991

INVENTOR(S) : Foley

It is certified that error appears in the above-identified patent and that said Letters Patent is hereby corrected as shown below:

Claim 1, line 33 change "tot he" to --to the--.

Claim 3, line 1 after "further" add --comprising a collection manifold at the other of said ends of the chamber, the outlet manifold having a plurality of--.

Claim 7, line 7 change "frmo" to --from--.

line 21 change "tot he" to --to the--.

Signed and Sealed this

Twenty-third Day of June, 1992

*Attest:*

DOUGLAS B. COMER

*Attesting Officer*

*Acting Commissioner of Patents and Trademarks*